US009534345B2

(12) United States Patent
Blackstone

(10) Patent No.: US 9,534,345 B2
(45) Date of Patent: Jan. 3, 2017

(54) SAMPLING ASSEMBLY AND METHOD

(71) Applicant: William Blackstone, De Kalb, TX (US)

(72) Inventor: William Blackstone, De Kalb, TX (US)

( * ) Notice: Subject to any disclaimer, the term of this patent is extended or adjusted under 35 U.S.C. 154(b) by 36 days.

(21) Appl. No.: 14/564,616

(22) Filed: Dec. 9, 2014

(65) Prior Publication Data

US 2016/0160441 A1 Jun. 9, 2016

(51) Int. Cl.
*D21F 1/06* (2006.01)
*D21C 1/00* (2006.01)

(52) U.S. Cl.
CPC ..... *D21C 1/00* (2013.01)

(58) Field of Classification Search
CPC ..... D21F 1/06; D21G 9/00
USPC ..... 162/232, 263, 198
See application file for complete search history.

(56) References Cited

U.S. PATENT DOCUMENTS 3,182,502 A * 5/1965 Mayes ..... G01F 23/268 73/223
4,101,282 A * 7/1978 Ririe ..... G01N 33/0011 422/93
4,517,053 A * 5/1985 Devine ..... B01D 35/22 162/238
6,499,344 B2 * 12/2002 Nelson ..... E21B 43/34 166/250.16
2002/0020215 A1 * 2/2002 Nelson ..... E21B 43/34 73/152.23
2006/0107669 A1 * 5/2006 Radisch ..... B01D 53/265 62/93

* cited by examiner

*Primary Examiner* — Mark Halpern
(74) *Attorney, Agent, or Firm* — Slater Matsil, LLP

(57) ABSTRACT

A sampling assembly and a method of operation of a sampling assembly are described. An assembly according to an embodiment includes an inlet, an outlet, a liquid-flowing section disposed between the inlet and the outlet, a vapor-flowing section disposed between the inlet and the outlet, and a probe port on the liquid-flowing section. The vapor-flowing section is distinct from and above the liquid-flowing section. A method according to an embodiment includes receiving a liquid chemical interspersed with a gas at an inlet of a sampling assembly and segregating the liquid chemical from the gas. The liquid chemical flows in a liquid-flowing section of the sampling assembly, and the gas flows in a vapor-flowing section of the sampling assembly. The method further includes monitoring a property of the liquid chemical in the liquid-flowing section and releasing the liquid chemical and the gas through an outlet of the sampling assembly.

20 Claims, 5 Drawing Sheets

SAMPLING ASSEMBLY AND METHOD

BACKGROUND

Paper is generally created from wood through many processes. These processes can include a physical breakdown of logs into chips and a chemical breakdown pulp into fibers. Chemical processes can include dangerous acidic and caustic chemicals. Throughout chemical processes, the chemicals can be monitored to ensure the integrity of the processes and the quality of the produced paper. Further, workers' safety in monitoring these chemicals is always a concern. As an example, chlorine dioxide may be used in some of these processes and is a dangerous liquid and gas that can be emitted by those processes.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

Embodiments will be described with respect to a specific context, namely a paper mill. More specifically, embodiments are described with respect to sampling assemblies used in a paper mill. Other embodiments may also be applied in other contexts where a pressurized gas is interspersed among a liquid and where the pressurized gas should be safely released.

Figure 1:
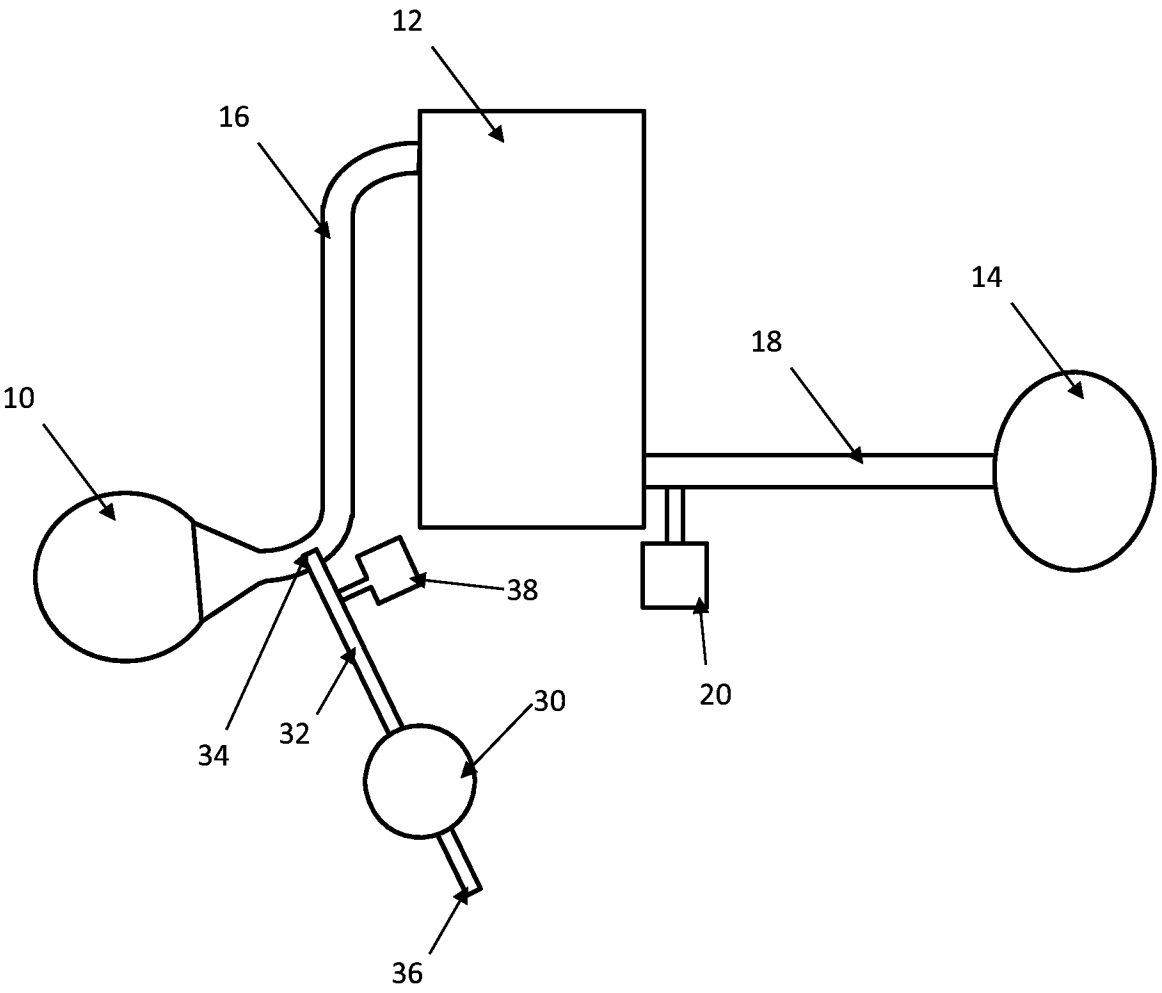
FIG. 1 is a system for bleaching pulp stock in a paper formation process in accordance with some embodiments.

FIG. 1 illustrates a system for bleaching pulp stock in a paper formation process. The system includes a chemical mixer 10, a retention tower 12, and a washer 14. The chemical mixer 10 mixes various chemicals and product, such as fiber, water, and chlorine dioxide ($ClO_2$), to form a slurry. The chemical mixer 10 can include an agitation pump to facilitate the mixing of these chemicals and products. Once the slurry is formed in the chemical mixer 10, the slurry is pumped through tubing 16, which may be referred to as pre-tension tubing, to the retention tower 12. The slurry can undergo fast, initial chemical reactions in the tubing 16. Once pumped into the retention tower 12, the slurry can undergo slower chemical reactions. The retention tower 12 allows for a retention time, for example, of about 3 hours, in which these slower chemical reactions can occur. The retention tower 12 can retain, for example, between 20 tons and 25 tons of the slurry and/or reacted stock and water. From the retention tower 12, a mixture of stock, water, and any residual chemical, such as chlorine dioxide, is pumped by a pump 20 through tubing 18 to the washer 14. The washer 14 can include a drum with a vacuum such that a mat of the stock is formed on the drum. The stock can subsequently be further processed into paper.

It may be desirous to monitor properties of the various chemicals in the system of FIG. 1. In some embodiments, a sampling assembly 30 is coupled to the tubing 16 proximate the chemical mixer 10. As discussed in more detail below, the sampling assembly 30 allows for monitoring of chemicals in the slurry in the tubing 16 and for taking a specimen of the chemicals. Tubing 32 couples the sampling assembly 30 to the tubing 16 through which the slurry is pump from the chemical mixer 10 to the retention tower 12. Tubing 32 couples tubing 16 proximate to the chemical mixer 10. Tubing 32 can extend into tubing 16. At the end of tubing 32 that extends into tubing 16 is a strainer 34. The strainer 34 can be a cap and/or mesh that substantially prevents the fiber in the slurry from entering into tubing 32 and allows chemicals in the slurry, such as water and chlorine dioxide, to enter into the tubing 32. The chemicals that enter the tubing 32 then flow to the sampling assembly 30, where properties of the chemicals, such as pH, can be monitored or a specimen taken. Once monitored, the chemicals can flow from the sampling assembly to a drain 36, where the chemicals may be further diluted and/or consumed.

Occasionally, fiber in the slurry may block or clog the strainer 34. Accordingly, a device 38 is coupled to the tubing 32 and is configured to remove fiber from the strainer 34. The device 38 may release a pressurized gas, such as air, into the tubing 32. The pressurized gas can blow fiber off of the strainer 34 back into the tubing 16. Further, residual pressurized gas can be released through the sampling assembly 30 and to the drain 36. The device 38 may be a sampler from Metso Automation.

Figure 2:
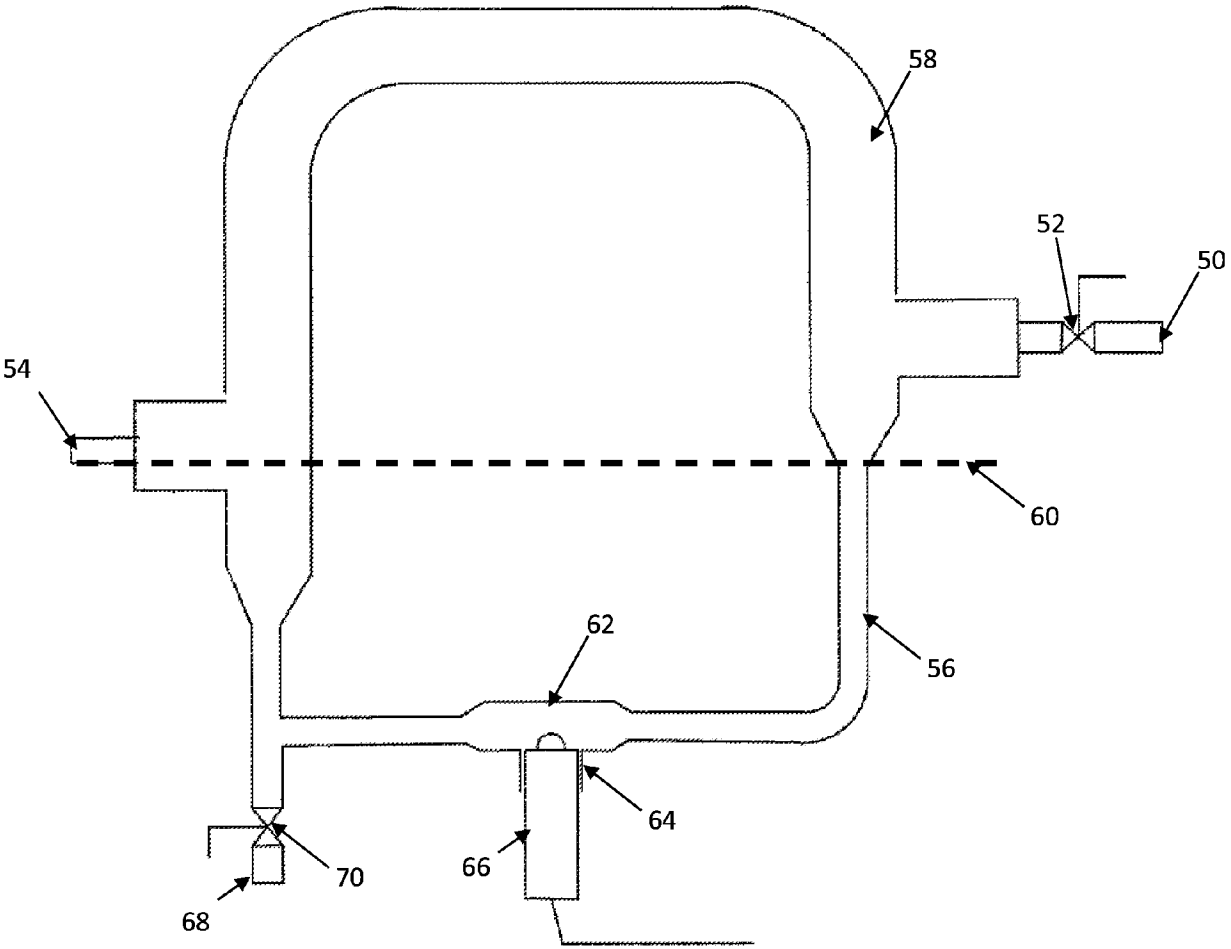
FIG. 2 is a first sampling assembly in accordance with some embodiments.

FIG. 2 illustrates in more detail a sampling assembly, such as the sampling assembly 30 in FIG. 1, in accordance with some embodiments. The sampling assembly has an inlet 50, such as from tubing 32 in FIG. 1, with a valve 52, such as a manual valve, and an outlet 54, such as to the drain 36 in FIG. 1. The sampling assembly includes a liquid-flowing section 56 and a vapor-flowing section 58, with each being between the inlet 50 and the outlet 54. When installed, the vapor-flowing section 58 is above the liquid-flowing section 56. A liquid fill level line 60, when the sampling assembly is installed, for example, on a stanchion such that the liquid fill level line 60 is oriented as depicted, is level with the outlet 54 and is below the inlet 50. The liquid-flowing section 56 is substantially a U-shape section of, for example, tubing or piping below the liquid fill level line 60. The vapor-flowing section 58 is substantially an inverted U-shape section of, for example, tubing or piping above the liquid fill level line 60. The vapor-flowing section 58 and the liquid-flowing section 56 are coupled together proximate the inlet 50 and the outlet 54 to form an enclosed loop.

The liquid-flowing section 56 includes tubing or piping of a size comparable to a size of the inlet 50, which can be comparable to a size of tubing 32. In this way, a flow of chemicals from the tubing 32 can remain substantially constant through the liquid-flowing section 56 to prevent pooling of old chemicals in the liquid-flowing section 56 that can taint a current measurement of properties of the chemicals. In this manner, the chemicals measured at a measurement section 62, which will be discussed later, is representative of actual process conditions. Further, it may be desirable for the liquid-flowing section 56 to retain an amount of the chemicals when the valve 52 is closed that would be sufficient for a specimen, such as 2000 mL. The vapor-flowing section 58 includes tubing or piping of a size larger than the size of the inlet 50 and the size of the liquid-flowing section 56.

The liquid-flowing section 56 further includes the measurement section 62 with a probe port 64. The probe port 64 may receive, for example, a pH electrode 66, which may be a common twist lock of ¾ inch threaded pH probe, that can measure the pH of the chemicals flowing through the measurement section 62. Other monitoring equipment to be inserted into the probe port 64 may include a temperature gauge, an oxygen reduction potential (ORP) electrode, or the like. The liquid-flowing section 56 also includes a specimen port 68 with a valve 70, such as a manual valve. The specimen port 68 can allow an individual to remove a specimen from the sampling assembly for further testing at a location remote from the sampling assembly.

Materials of the sampling assembly are substantially resistant to chemicals flowing through the sampling assembly. For example, the materials are substantially chemically resistant to chlorine dioxide and other acidic or caustic process fluids. For example, if the chemicals are a mixture of water and chlorine dioxide, appropriate materials may include chlorinated polyvinyl chloride (CPVC), polytetrafluoroethylene (PTFE), titanium, fiberglass, the like, or a combination thereof. Further, the sampling assembly may be rated for chemical temperatures not to exceed 100° C. and for process pressure not to exceed 100 psig.

Figure 3:
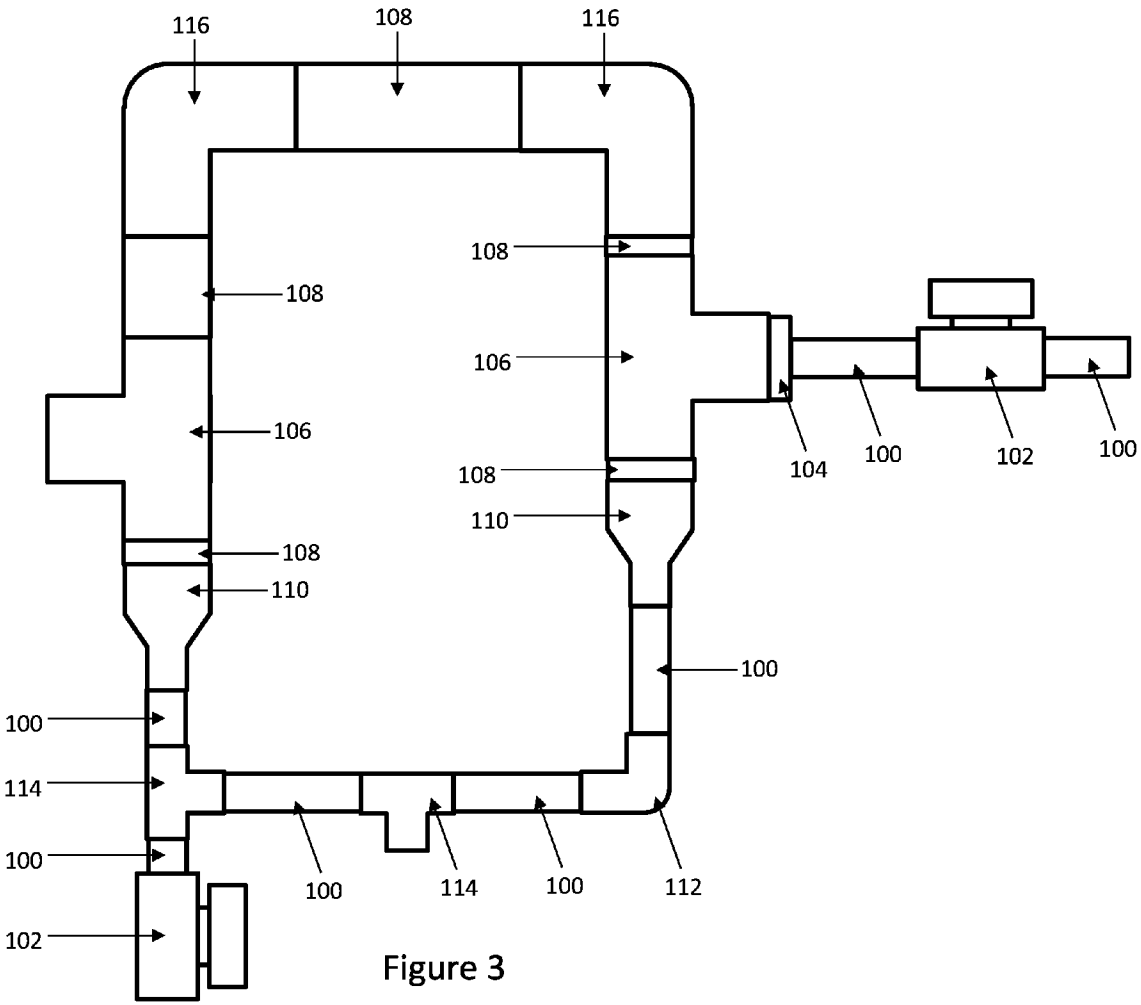
FIG. 3 is a specific example of a sampling assembly, identifying components of a construction of the sampling assembly, in accordance with some embodiments.

FIG. 3 illustrates a specific example of a sampling assembly to further illustrate a construction of some embodiments. One of ordinary skill in the art will readily understand the relationship of the components described in FIG. 3 to the generalized sampling assembly of FIG. 2. Each of the components in FIG. 3 is schedule 80 CPVC. Sections of ¾ inch diameter tubing are illustrated as component 100. ¾ inch diameter valves are illustrated as component 102. A ¾ inch diameter adapter for a 2 inch diameter fitting is illustrated as component 104. 2 inch diameter by 2 inch diameter by 2 inch diameter Tee fittings are illustrated as component 106. Sections of 2 inch diameter tubing are illustrated as component 108. 2 inch diameter by ¾ inch diameter couplings are illustrated as component 110. A ¾ inch diameter 90 degree elbow is illustrated as component 112. ¾ inch diameter by ¾ inch diameter by ¾ inch diameter Tee fittings are illustrated as component 114. 2 inch diameter 90 degree elbows are illustrated as component 116.

With reference back to FIG. 2, under normal operating conditions, chemicals from the slurry flow from tubing 32, in the inlet 50, through the valve 52, through the liquid-flowing section 56, and out the outlet 54 to the drain. The valve 52 remains open and the valve 70 remains closed under these conditions. The pH electrode 66 in the measurement section 62 can monitor a pH of the chemicals flowing through the liquid-flowing section 56.

When a pressurized gas is released into tubing 32 to clear the strainer 34, residual pressurized gas can enter from tubing 32 in the inlet 50, through the valve 52, and into the vapor-flowing section 58. The pressurized gas, such as air, being less dense than the liquid chemicals can be segregated from the liquid chemicals and flow in the vapor-flowing section 58. The larger sized vapor-flowing section 58 allows at least some of the pressure to dissipate over the larger volume of tubing. Further, pressure from the pressurized gas may apply a pressure on liquids flowing through the liquid-flowing section 56. Since the vapor-flowing section 58 couples the liquid-flowing section 56 at two locations, with the measurement section 62 disposed along the liquid-flowing section 56 between those two locations, substantially equal force can be applied by the pressurized gas to the liquid in the liquid-flowing section 56 at both locations, and the forces may substantially cancel each other out in the measurement section 62. Hence, spikes or anomalies in pH monitoring due to the release of pressurized gas can be reduced or mitigated. The pressurized gas can further be released through the outlet 54 to a drain.

To obtain a specimen from the sampling assembly, an individual can first close valve 52. Then, valve 70 can be opened to release chemicals through the specimen port 68 such that a specimen can be collected. Once the specimen has been collected, the valve 70 can be closed, and subsequently, valve 52 can be opened to return the sampling assembly to normal operation. Opening and closing the valves 52 and 70 in this sequence can prevent any sudden discharges of pressurized gas from entering into the sampling assembly during the collection of the specimen, which could cause a violent discharge of chemicals from the specimen port 68.

Figure 4:
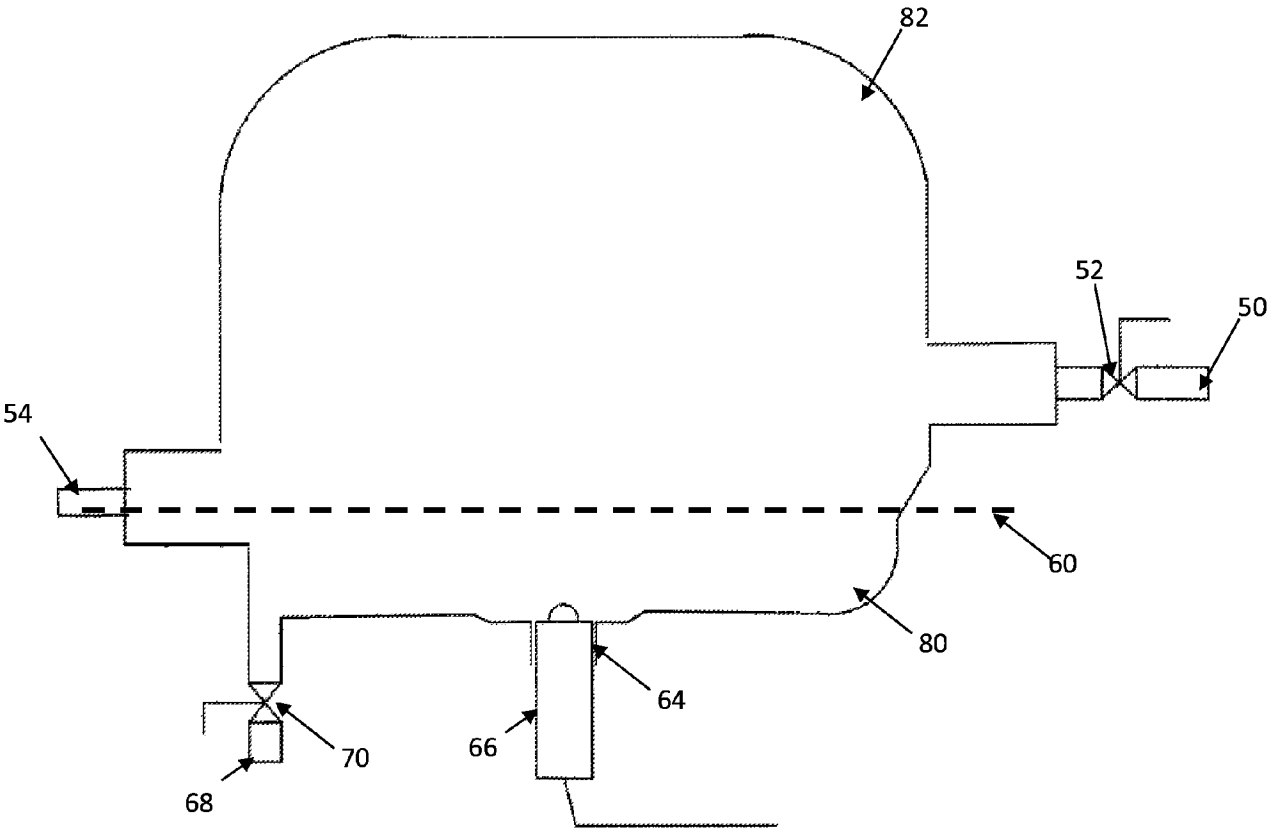
FIG. 4 is a second sampling assembly in accordance with some embodiments.

FIG. 4 illustrates in more detail another sampling assembly, such as the sampling assembly 30 in FIG. 1, in accordance with some embodiments. The sampling assembly of FIG. 4 has a liquid-flowing section 80 and a vapor-flowing section 82 that together substantially consists of a single tank, chamber, container, or the like. For ease of reference, the liquid-flowing section 80 and the vapor-flowing section 82 will be referred to as a tank. The liquid-flowing section 80 is a bottom portion of the tank below the liquid fill level line 60. The volume of the liquid-flowing section 80 may be optimized to minimize pooling of the liquid chemicals flowing through the sampling assembly. This volume optimization can help ensure that the liquid chemicals flowing past the pH electrode 66 are actually representative of chemicals in a slurry. Further, it may be desirable for the liquid-flowing section 80 to retain an amount of the chemicals when the valve 52 is closed that would be sufficient for a specimen, such as 2000 mL. The volume of the vapor-flowing section 82 can be any volume, such as a volume sufficient to dissipate residual pressurized gas from tubing 32. The sampling assembly of FIG. 4 includes some components that the assembly of FIG. 2 includes, and description of those components is omitted here for brevity.

The principles of the operation of the sampling assembly of FIG. 4 are generally the same as discussed above with respect to the sampling assembly of FIG. 2. When a pressurized gas is released into tubing 32 to clear the strainer 34, residual pressurized gas can enter from tubing 32 in the inlet 50, through the valve 52, and into the vapor-flowing section 82. The pressurized gas, such as air, being less dense than the liquid chemicals can be segregated from the liquid chemicals and flow in the vapor-flowing section 82. The larger volume of the vapor-flowing section 82 allows at least some of the pressure to dissipate. Further, pressure from the pressurized gas may apply a pressure on liquid flowing through the liquid-flowing section 80. This pressure may be applied substantially uniformly on the top surface of the liquid at the liquid fill level line 60, which may result in a downward force. Since any force would be downward, measurements by the pH electrode 66 may not be significantly affected. Hence, spikes or anomalies in pH monitoring due to the release of pressurized gas can be reduced or mitigated. The pressurized gas can further be released through the outlet 54 to a drain.

Figure 5:
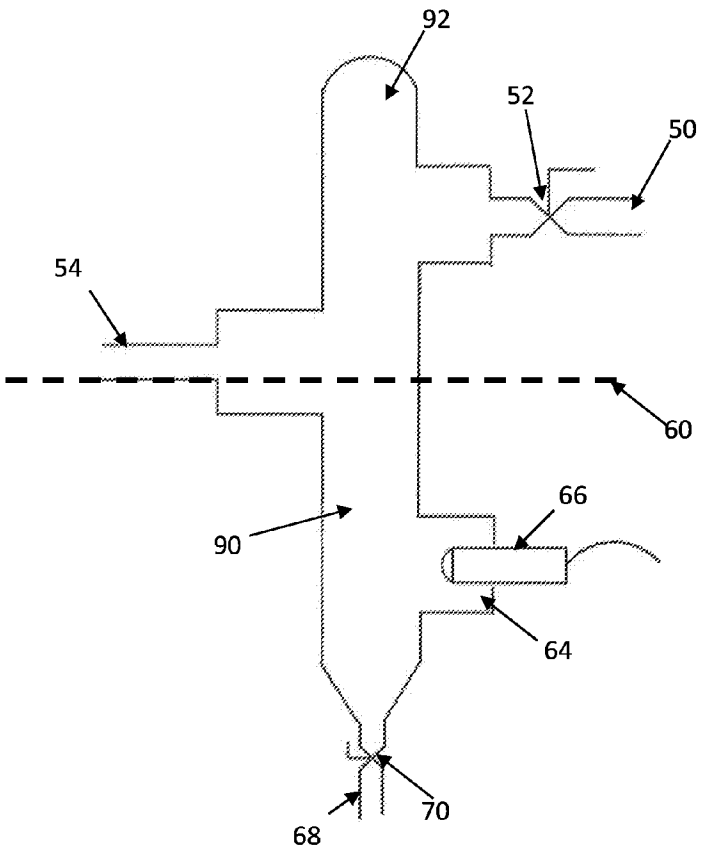
FIG. 5 is a third sampling assembly in accordance with some embodiments.

FIG. 5 illustrates in more detail another sampling assembly, such as the sampling assembly 30 in FIG. 1, in accordance with some embodiments. The sampling assembly of FIG. 5 has a liquid-flowing section 90 and a vapor-flowing section 92 that together consists of a vertically oriented pipe with capped ends or the like. The liquid-flowing section 90 is a bottom portion of the pipe below the liquid fill level line 60. The probe port 64 is through a vertical sidewall of the pipe in the liquid-flowing section 90. The volume of the liquid-flowing section 90 may be optimized to minimize pooling of the liquid chemicals flowing through the sampling assembly. This volume optimization can help ensure that the liquid chemicals flowing past the pH electrode 66 are actually representative of chemicals in a slurry. Further, it may be desirable for the liquid-flowing section 90 to retain an amount of the chemicals when the valve 52 is closed that would be sufficient for a specimen, such as 2000 mL. The specimen port 68 and valve 70 for taking the specimen are at a bottom of the vertically oriented pipe. The volume of the vapor-flowing section 92 can be any volume, such as a volume sufficient to dissipate residual pressurized gas from tubing 32. The sampling assembly of FIG. 5 includes some components that the assembly of FIG. 2 includes, and description of those components is omitted here for brevity.

The principles of the operation of the sampling assembly of FIG. 5 are generally the same as discussed above with respect to the sampling assembly of FIG. 2. When a pressurized gas is released into tubing 32 to clear the strainer 34, residual pressurized gas can enter from tubing 32 in the inlet 50, through the valve 52, and into the vapor-flowing section 92. The pressurized gas, such as air, being less dense than the liquid chemicals can be segregated from the liquid chemicals and flow in the vapor-flowing section 92. The larger volume of the vapor-flowing section 92 allows at least some of the pressure to dissipate. Further, pressure from the pressurized gas may apply a pressure on liquid flowing through the liquid-flowing section 90. This pressure may be applied substantially uniformly on the top surface of the liquid at the liquid fill level line 60, which may result in a downward force. Since any force would be downward and would be counteracted by the pipe, measurements by the pH electrode 66 may not be significantly affected. Hence, spikes or anomalies in pH monitoring due to the release of pressurized gas can be reduced or mitigated. The pressurized gas can further be released through the outlet 54 to a drain.

Although the present embodiments and their advantages have been described in detail, it should be understood that various changes, substitutions and alterations can be made herein without departing from the spirit and scope of the disclosure as defined by the appended claims. For example, various materials can be used, and various modifications to vapor-flowing section and a liquid-flowing section may be made.

While this invention has been described with reference to illustrative embodiments, this description is not intended to be construed in a limiting sense. Various modifications and combinations of the illustrative embodiments, as well as other embodiments, will be apparent to persons skilled in the art upon reference to the description. It is therefore intended that the appended claims encompass any such modifications or embodiments.

What is claimed is:

1. An assembly comprising:
- an inlet;
- an outlet having a cross-sectional area;
- a liquid-flowing section disposed between the inlet and the outlet;
- a probe port on the liquid-flowing section; and
- a vapor-flowing section disposed between the inlet and the outlet, the vapor-flowing section being distinct from and above the liquid-flowing section, wherein the liquid-flowing section and the vapor-flowing section are configured to define a liquid/vapor phase boundary disposed therebetween, and the liquid/vapor phase boundary is disposed at a bottom portion of the cross-sectional area of the outlet.

2. The assembly of claim 1 further comprising a valve on the inlet.

3. The assembly of claim 1 further comprising a specimen port on the liquid-flowing section, and a valve on the specimen port.

4. The assembly of claim 1, wherein the inlet is disposed above the liquid/vapor phase boundary.

5. The assembly of claim 1, wherein the liquid-flowing section comprises first tubing having a first diameter, and the vapor-flowing section comprises second tubing having a second diameter, the first diameter being smaller than the second diameter.

6. The assembly of claim 5, wherein the first diameter is equal to a diameter of the inlet.

7. The assembly of claim 1, wherein a single tank is the liquid-flowing section and the vapor-flowing section, the vapor-flowing section being a first volume of the single tank above the outlet, the liquid-flowing section being a second volume of the single tank below the outlet.

8. The assembly of claim 1, wherein:
- a pipe is the liquid-flowing section and the vapor-flowing section;
- the vapor-flowing section is a first volume of the pipe above the outlet;
- the liquid-flowing section is a second volume of the pipe below the outlet; and
- the pipe is vertically oriented and end-capped.

9. The assembly of claim 1, wherein a material of the vapor-flowing section and a material of the liquid-flowing section include chlorinated polyvinyl chloride (CPVC), polytetrafluoroethylene (PTFE), titanium, fiberglass, or a combination thereof.

10. An assembly comprising:
- a vessel, a first volume of the vessel defining a liquid-flowing section, and a second volume of the vessel defining a vapor-flowing section, wherein the liquid-flowing section and the vapor-flowing section define a liquid level line disposed therebetween;
- a probe port on the vessel at the liquid-flowing section;
- an inlet on the vessel, the inlet having a first cross-sectional area; and
- an outlet on the vessel, the outlet having a second cross-sectional area, wherein:
  - the liquid level line is disposed at a bottom portion of the second cross-sectional area;
  - the first cross-sectional area is above the liquid level line;
  - the first volume is at and below the liquid level line; and
  - the second volume is above the liquid level line.

11. The assembly of claim 10 further comprising a valve on the inlet.

12. The assembly of claim 10 further comprising a specimen port on the liquid-flowing section, and a valve on the specimen port.

13. The assembly of claim 10, wherein the vessel is a tank.

14. The assembly of claim 10, wherein the vessel is a vertically oriented, end-capped pipe.

15. An apparatus comprising:

a vessel having a first section, a second section, an inlet, and an outlet, wherein:

the first section comprises a u-shaped vapor conduit having a first end and a second end;

the second section comprises a u-shaped liquid conduit having a third end and a fourth end, the first end coupled to the third end, the second end coupled to the fourth end;

the outlet has a first cross-sectional area;

the u-shaped vapor conduit and the u-shaped liquid conduit defining a vapor/liquid boundary disposed therebetween, the vapor/liquid boundary disposed in a lower portion of the first cross-sectional area;

the inlet disposed fully above the vapor/liquid boundary; and the u-shaped liquid conduit comprising a probe port.

16. The apparatus of claim 15 further comprising a first valve on the inlet.

17. The apparatus of claim 16 further comprising a port on the second section, and a second valve being on the port.

18. The apparatus of claim 15, wherein at least one of:

vapor is disposed in the first section; or liquid is disposed in the second section.

19. The apparatus of claim 15, wherein the first section comprises first tubing having a first diameter, the second section comprises second tubing having a second diameter, and the first diameter is larger than the second diameter.

20. The apparatus of claim 19, wherein the second diameter is equal to a diameter of the inlet.

* * * * *